US010879021B2

(12) United States Patent
Lu et al.

(10) Patent No.: US 10,879,021 B2
(45) Date of Patent: Dec. 29, 2020

(54) KEYBOARD

(71) Applicant: Chicony Electronics Co., Ltd., New Taipei (TW)

(72) Inventors: Ji-Hung Lu, New Taipei (TW); Cheng-Chi Hsu, New Taipei (TW)

(73) Assignee: Chicony Electronics Co., Ltd., New Taipei (TW)

( * ) Notice: Subject to any disclaimer, the term of this patent is extended or adjusted under 35 U.S.C. 154(b) by 0 days.

(21) Appl. No.: 16/517,655

(22) Filed: Jul. 21, 2019

(65) Prior Publication Data

US 2020/0286699 A1 Sep. 10, 2020

(30) Foreign Application Priority Data

Mar. 8, 2019 (TW) ..... 108107899 A

(51) Int. Cl.
*H01H 13/70* (2006.01)
*H01H 13/85* (2006.01)

(52) U.S. Cl.
CPC ..... *H01H 13/85* (2013.01); *H01H 13/7006* (2013.01)

(58) Field of Classification Search
CPC ..... H01H 13/705; H01H 13/85; H01H 13/84; H01H 3/125; H01H 13/7006; H01H 2233/034; H01H 3/14; H01H 13/023; H01H 13/14
USPC ..... 200/345, 344, 341, 5 A
See application file for complete search history.

(56) References Cited

U.S. PATENT DOCUMENTS 5,994,655 A * 11/1999 Tsai ..... H01H 3/125 200/344
6,448,520 B1 * 9/2002 Inoue ..... H01H 3/125 200/341
6,590,565 B2 * 7/2003 Hosoya ..... G06F 1/1616 345/168
6,642,466 B1 * 11/2003 Lu ..... H01H 3/125 200/344
7,173,200 B2 * 2/2007 Yoneyama ..... H01H 3/125 200/344
7,973,254 B2 * 7/2011 Yeh ..... H01H 3/125 200/344
8,110,764 B2 * 2/2012 Hsu ..... H01H 3/125 200/344

(Continued)

FOREIGN PATENT DOCUMENTS

CN 202601436 U 12/2012
TW 201426795 7/2014
TW 201907427 A 2/2019

*Primary Examiner* — William A Bolton
(74) *Attorney, Agent, or Firm* — CKC & Partners Co., LLC

(57) ABSTRACT

A keyboard includes a base, a keycap, and a connecting assembly. The keycap is located over the base. The connecting assembly is located between the base and the keycap and includes a first connecting member and a second connecting member connected to each other. Each of the first and second connecting members is connected to the base and the keycap. Two connected members of the base, the keycap, and the first and second connecting members are fixedly connected. When the keycap is pressed toward the base, at least one of the first and second connecting members elastically deforms to store elastic potential energy. When the keycap is released, said at least one of the first and second connecting members elastically recovers to return the keycap to its original position.

15 Claims, 13 Drawing Sheets

(56) References Cited

U.S. PATENT DOCUMENTS

| | | | | |
|---|---|---|---|---|
| 8,581,130 | B2 * | 11/2013 | Jhuang | H01H 3/125 200/344 |
| 9,214,293 | B2 * | 12/2015 | Chen | H01H 3/125 |
| 2014/0174900 | A1 | 6/2014 | Hsu | |

* cited by examiner

KEYBOARD

CROSS-REFERENCE TO RELATED APPLICATION

This application claims priority to Taiwan Application Serial Number 108107899, filed Mar. 8, 2019, which is herein incorporated by reference.

BACKGROUND

Technical Field

The present disclosure relates to a keyboard.

Description of Related Art

Currently, the keyboard is one of the indispensable input devices to enter text or numbers while using a personal computer (PC). Moreover, consumer electronic products used in daily life or large-scale processing equipment used in the industrial sector require key structure units as input devices to be operated.

For a keyswitch on a keyboard, in order to guide the keycap to move up and down, a connection structure is usually disposed under the keycap of the keyswitch. Therefore, regardless of a force applied to sides or corners of the keycap, the force can be evenly distributed over the entire surface of the keycap.

For a current notebook computer, its development direction is to be light and thin, therefore the keyboard structure thereof must be improved to meet the above requirements and also has to reduce the overall vertical height of the keyswitches and simplify the mechanism, so as to better meet the current changing direction and market demand of electronic devices. However, in a thinned keyswitch, the rubber dome has almost no function of providing a feeling of pressing (i.e., a stepped sense) in addition to providing electrical conduction, triggering a keyswitch signal, and providing resilience.

Accordingly, how to provide a keyboard to solve the aforementioned problems becomes an important issue to be solved by those in the industry.

SUMMARY

An aspect of the disclosure is to provide a keyboard which can effectively solve the aforementioned problems.

According to an embodiment of the disclosure, a keyboard includes a base, a keycap, and a connecting assembly. The keycap is located over the base. The connecting assembly is located between the base and the keycap and includes a first connecting member and a second connecting member connected to each other. Each of the first and second connecting members is connected to the base and the keycap. Two connected members of the base, the keycap, and the first and second connecting members are fixedly connected. When the keycap is pressed toward the base, at least one of the first and second connecting members elastically deforms to store elastic potential energy. When the keycap is released, said at least one of the first and second connecting members elastically recovers to return the keycap to its original position.

In an embodiment of the disclosure, said two connected members are detachably connected.

In an embodiment of the disclosure, said two connected members are the first and second connecting members. Each of the first and second connecting members has a connecting portion. The connecting portions of the first and second connecting members are engaged with each other and unable to rotate relative to each other.

In an embodiment of the disclosure, said two connected members are one of the first and second connecting members and the base. Said one of the first and second connecting members has a lower engaging shaft. The base has a coupling mechanism. The lower engaging shaft and the coupling mechanism are engaged with each other and unable to rotate relative to each other.

In an embodiment of the disclosure, said two connected members are one of the first and second connecting members and the keycap. Said one of the first and second connecting members has an upper engaging shaft. The keycap has an engaging portion. The upper engaging shaft and the engaging portion are engaged with each other and unable to rotate relative to each other.

In an embodiment of the disclosure, said two connected members are two portions of a unitary structure.

In an embodiment of the disclosure, the keyboard further includes a circuit board and a triggering member. The base partially passes through the circuit board to be connected to the connecting assembly. The triggering member is disposed on the connecting assembly and faces toward the circuit board.

In an embodiment of the disclosure, the first connecting member surrounds an outer edge of the second connecting member. The triggering member is disposed on a surface of the second connecting member facing toward the circuit board.

In an embodiment of the disclosure, the triggering member is substantially located at a center of the surface of the second connecting member.

In an embodiment of the disclosure, the triggering member is close to an edge of the keycap.

In an embodiment of the disclosure, the connecting assembly is configured to guide the keycap to move between a highest position and a lowest position relative to the base. Two adjacent members of the base, the keycap, and the first and second connecting members respectively have a protrusion and a recess. During a movement of the keycap from the highest position toward the lowest position, the protrusion slidably abuts against one of said adjacent members having the recess and is located outside the recess. When the keycap is located at the lowest position, the protrusion falls into the recess.

In an embodiment of the disclosure, said adjacent members are the first and second connecting members.

In an embodiment of the disclosure, the first connecting member surrounds an outer edge of the second connecting member. Said adjacent members are the first connecting member and the keycap.

In an embodiment of the disclosure, said adjacent members are one of the first and second connecting members and the base.

In an embodiment of the disclosure, the base includes a substrate and a plastic frame. The plastic frame is fixed on the substrate and connected to the first and second connecting members.

Accordingly, in the keyboard of the present disclosure, since two connected members of the base, the keycap, and the first and second connecting members are fixedly connected, at least one of said two connected members elastically deforms to store elastic potential energy when the keycap is pressed and elastically recovers to return the keycap to its original position when the keycap is released.

Moreover, in the keyboard of the present disclosure, two adjacent members of the base, the keycap, and the first and second connecting members respectively have a protrusion and a recess. When the keycap is pressed to move to the lowest position, the protrusion falls into the recess, so as to provide a feeling of pressing (i.e., a stepped sense) to the user. Therefore, the conventional rubber domes could be effectively replaced or cancelled according to the configuration of the keyboard of the present disclosure.

It is to be understood that both the foregoing general description and the following detailed description are by examples, and are intended to provide further explanation of the disclosure as claimed.

BRIEF DESCRIPTION OF THE DRAWINGS

The disclosure can be more fully understood by reading the following detailed description of the embodiment, with reference made to the accompanying drawings as follows.

DETAILED DESCRIPTION

Figure 1:
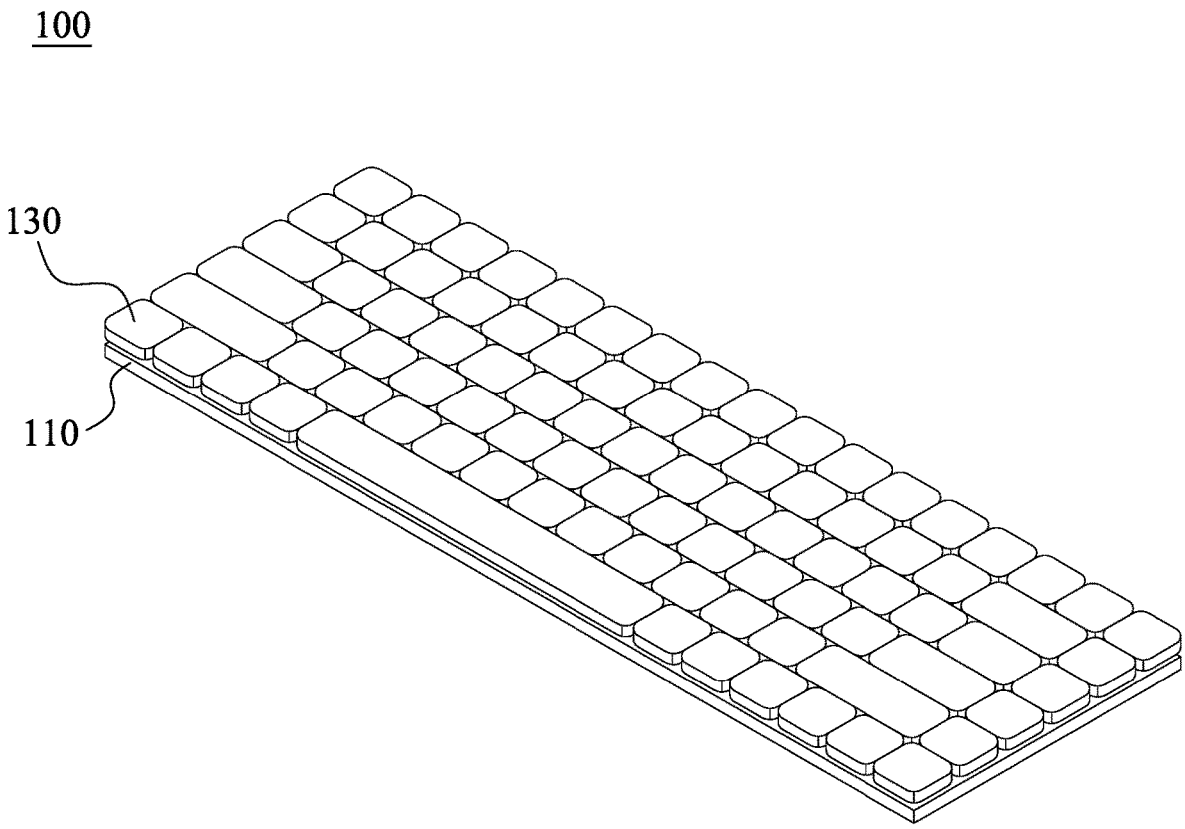
FIG. 1 is a perspective view of a keyboard according to an embodiment of the disclosure.

Reference will now be made in detail to the present embodiments of the disclosure, examples of which are illustrated in the accompanying drawings. Wherever possible, the same reference numbers are used in the drawings and the description to refer to the same or like parts. However, specific structural and functional details disclosed herein are merely representative for purposes of describing exemplary embodiments, and thus may be embodied in many alternate forms and should not be construed as limited to only exemplary embodiments set forth herein. Therefore, it should be understood that there is no intent to limit exemplary embodiments to the particular forms disclosed, but on the contrary, exemplary embodiments are to cover all modifications, equivalents, and alternatives falling within the scope of the disclosure.

Figure 2A:
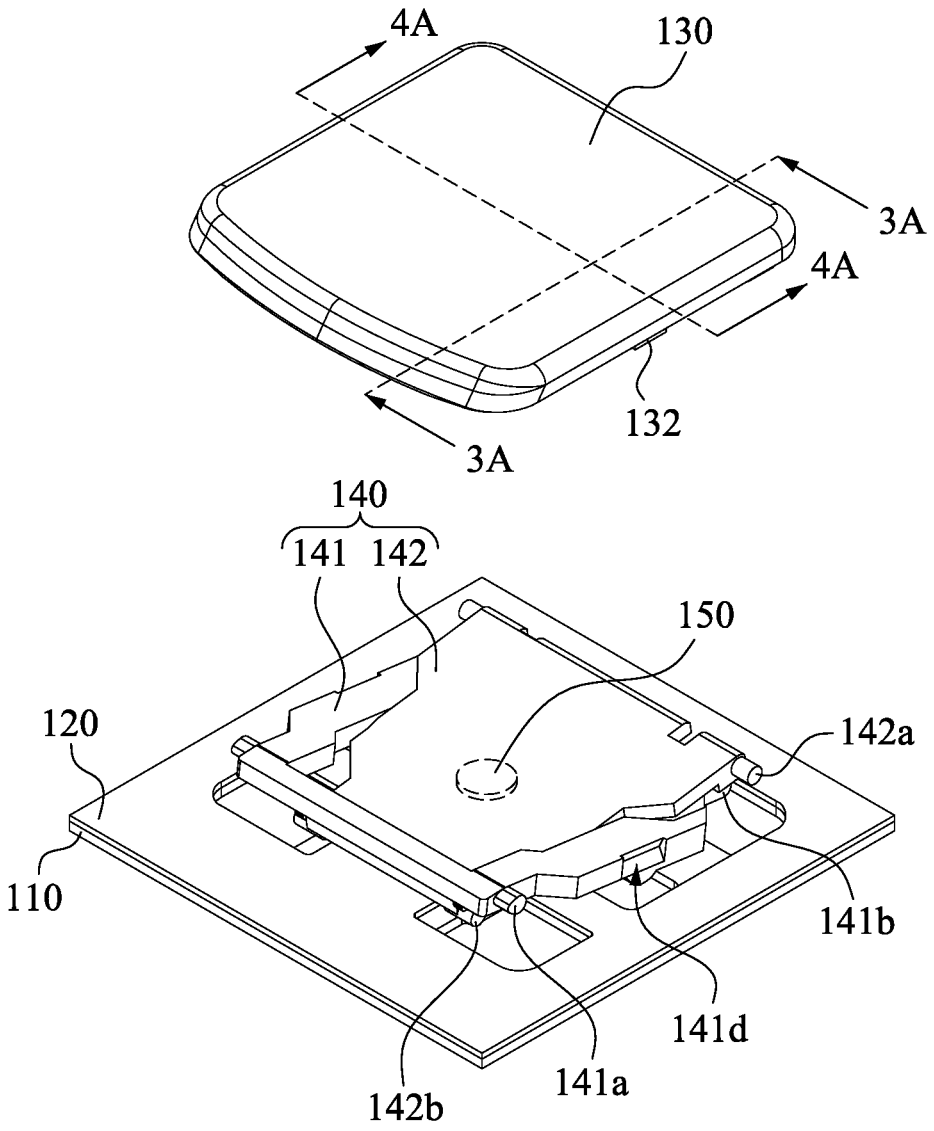
FIG. 2A is a partial perspective view of a keyswitch device according to an embodiment of the disclosure, in which a keycap is separated upward.
Figure 2B:
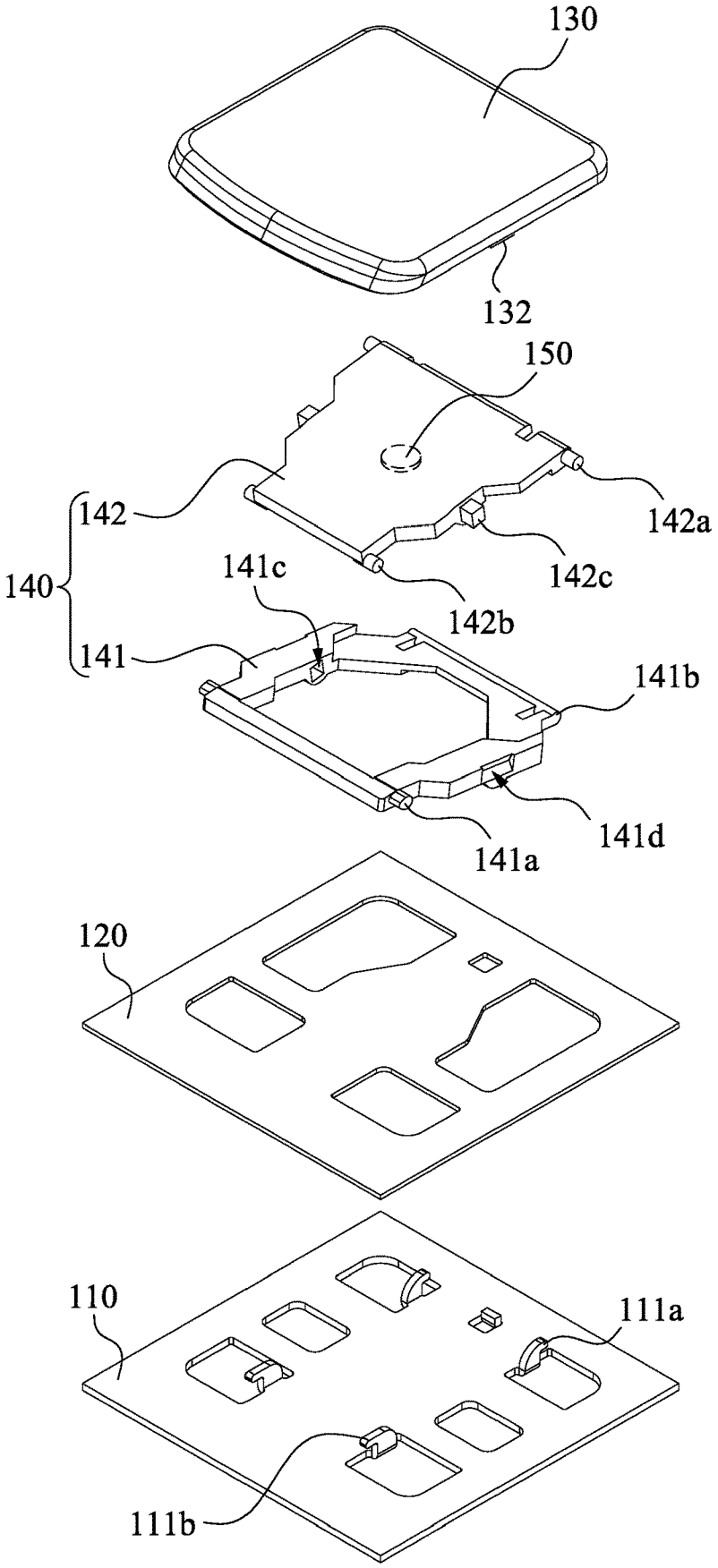
FIG. 2B is an exploded view of the keyswitch device shown in FIG. 2A.

Reference is made to FIGS. 1, 2A, and 1B. FIG. 1 is a perspective view of a keyboard 100 according to an embodiment of the disclosure. FIG. 2A is a partial perspective view of a keyswitch device according to an embodiment of the disclosure, in which a keycap 130 is separated upward. FIG. 2B is an exploded view of the keyswitch device shown in FIG. 2A. As shown in FIGS. 1 to 2B, the keyboard 100 of the disclosure can be an external keyboard (e.g., a keyboard with a PS/2 interface or a keyboard with a USB interface) used in a desktop computer, or can be a part of a computer system having an input device (e.g., a touch pad on a notebook computer) that is in the form of a keyswitch, but the disclosure is not limited in this regard. That is, concepts of the keyboard 100 of the disclosure can be used in any electronic product that performs input function by pressing. In the present embodiment, the keyboard 100 includes a plurality of the keyswitch devices. Structures and functions of components included in the keyboard 100 and connection and action relationships among these components are introduced in detail below.

As shown in FIGS. 1, 2A, and 1B, the keyswitch device of the keyboard 100 includes a base 110, a circuit board 120, a keycap 130, and a connecting assembly 140. These keyswitch devices share the base 110 and the circuit board 120. The keycap 130 is located over the base 110. The connecting assembly 140 is located between the base 110 and the keycap 130 and includes a first connecting member 141 and a second connecting member 142 connected to each other. Each of the first and second connecting members 141, 142 is connected to the base 110 and the keycap 130. As such, the connecting assembly 140 is capable of guiding the keycap 130 to move toward or away from the base 110 between a highest position (as the position shown in FIG. 3A) and a lowest position (as the position shown in FIG. 3B). In some embodiments, the base 110 is a metal plate, but the disclosure is not limited in this regard.

Figure 3A:
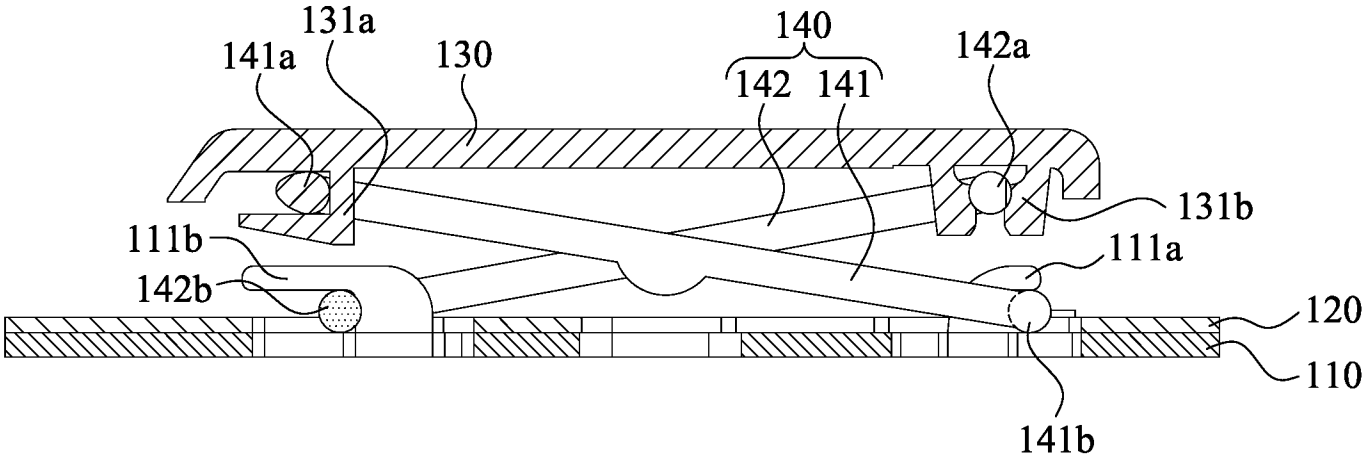
FIG. 3A is a cross-sectional view of the keyswitch device shown in FIG. 2A taken along line 3A-3A after assembled, in which the keycap is located at a highest position.
Figure 3B:
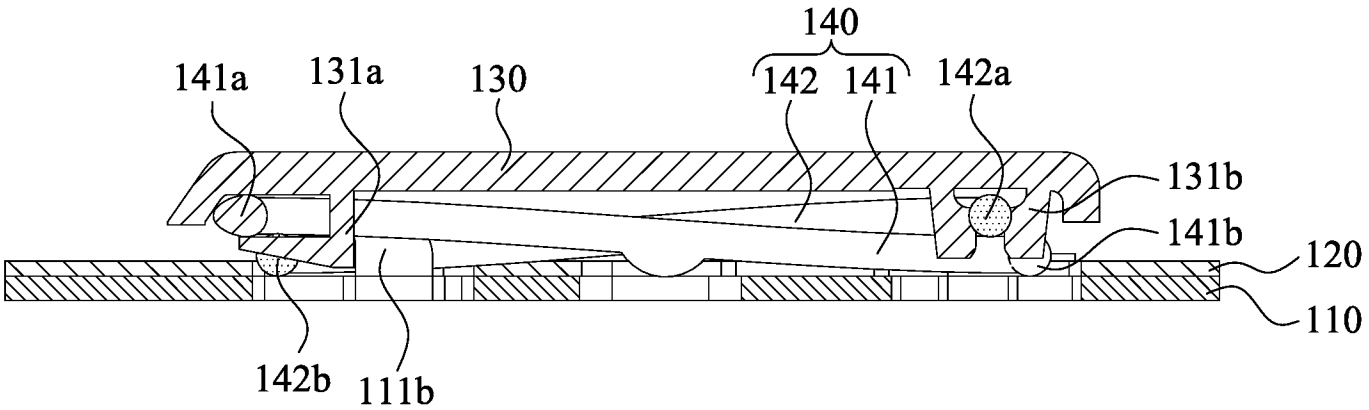
FIG. 3B is another cross-sectional view of the keyswitch device shown in FIG. 3A, in which the keycap is located at a lowest position.

Reference is made to FIGS. 3A and 3B. FIG. 3A is a cross-sectional view of the keyswitch device shown in FIG. 2A taken along line 3A-3A after assembled, in which the keycap 130 is located at the highest position. FIG. 3B is another cross-sectional view of the keyswitch device shown in FIG. 3A, in which the keycap 130 is located at a lowest position. As shown in FIGS. 2B to 3B, the base 110 includes coupling mechanisms 111*a*, 111*b* that pass through the circuit board 120. The coupling mechanisms 111*a*, 111*b* are hook structures formed by stamping a metal plate, but the disclosure is not limited in this regard. The coupling mechanisms 111*a*, 111*b* may also be structures such as pivotal holes, sliding chutes, and etc. The keycap 130 includes engaging portions 131*a*, 131*b*. The connecting assembly 140 includes the first connecting member 141 and the second connecting member 142. The first connecting member 141 includes a connecting portion 141*c*. The second connecting member 142 includes a connecting portion 142*c* which is engaged with the connecting portion 141*c* of the first connecting member 141. The first connecting member 141 further includes a first upper engaging shaft 141*a* and a first lower engaging shaft 141*b*. The second connecting member 142 further includes a second upper engaging shaft 142*a* and a second lower engaging shaft 142*b*. The first connecting member 141 is slidably engaged with the engaging portion 131*a* of the keycap 130 with the first upper engaging shaft 141*a* and pivotally connected to the coupling mechanism 111*a* disposed on the base 110 with the first lower engaging shaft 141*b*. The second connecting member 142 is pivotally connected to the engaging portion 131*b* of the keycap 130 with the second upper engaging shaft 142*a* and slidably engaged with the coupling mechanism 111*b* of the base 110 with the second lower engaging shaft 142*b*. The first upper engaging shaft 141*a* of the first connecting member 141 and the second lower engaging shaft 142*b* of the second connecting member 142 are located at the same side, and the first lower engaging shaft 141*b* of the first connecting member 141 and the second upper engaging shaft 142*a* of the second connecting member 142 are located at the same side. Therefore, during the keycap 130 is pressed, the sliding direction of the first upper engaging shaft 141*a* of the first connecting member 141 relative to the keycap 130 and the sliding direction of the second lower engaging shaft 142*b* of the second connecting member 142 relative to the base 110 are the same.

It should be noted that, for the keyboard 100 of the present disclosure, two connected members of the base 110, the keycap 130, and the first and second connecting members 141, 142 are fixedly connected. The term "fixedly connected" as used herein may be interpreted as "non-rotatably connected". As shown in the specific embodiment shown in FIG. 2B, said two connected members are the first and second connecting members 141, 142. In order to achieve the purpose of fixedly connecting the first and second connecting members 141, 142, the connecting portion 141*c* of the first connecting member 141 is designed as a non-circular hole (e.g., a square hole), and the connecting portion 142*c* of the second connecting member 142 is correspondingly designed as a non-circular shaft (e.g., a square shaft). The first and second connecting members 141, 142 are detachably connected. Hence, when the connecting portions 141*c*, 142*c* are engaged with each other, they are unable to rotate relative to each other (i.e., the shapes of the connecting portions 141*c*, 142*c* match each other when they are engaged). In practical applications, structures of the connecting portions 141*c*, 142*c* can be exchanged. In other embodiments, the first and second connecting members 141, 142 are two portions of a unitary structure. For example, the first and second connecting members 141, 142 include identical or different materials and can be fabricated into the unitary structure by an injection molding process.

With the foregoing structural configurations, when the keycap 130 is not pressed (as shown in FIG. 3A), the first and second connecting members 141, 142 that are fixedly connected can support and keep the keycap 130 at the highest position. When the keycap 130 is pressed (as shown in FIG. 3B), the first and second connecting members 141, 142 will interact with each other so as to guide the keycap 130 to move toward the base 110 and elastically deform to store elastic potential energy during the movement. From the perspective of FIG. 3B, the first upper engaging shaft 141*a* of the first connecting member 141 slides to the left, and the second lower engaging shaft 142*b* of the second connecting member 142 also slides to the left. When the keycap 130 is released, the first and second connecting members 141, 142 will elastically recover to return the keycap 130 to the highest position. In other words, the first and second connecting members 141, 142 that are fixedly connected to each other in the present embodiment can effectively provide the position-returning function provided by conventional rubber domes, so the conventional rubber domes could be effectively replaced according to the configuration of the keyboard 100 of the present disclosure.

In the present embodiment, the first connecting member 141 has a frame-like shape, and outer edges of the second connecting member 142 are engaged with inner edges of the first connecting member 141. Since the conventional rubber domes do not need to be installed in the keyboard 100 of the present disclosure, the second connecting member 142 can be in form of a sheet as shown in FIG. 2B which is distinct from the frame-like shape. In addition, since it is no need to install a conventional rubber dome at the center of the second connecting member 142, a width of the second connecting member 142 can be adequately reduced, such that a width between the opposite inner edges of the first connecting member 141 can also be adequately reduced and thus the structural strength of the first connecting member 141 can be increased. In practical applications, the first and second connecting members 141, 142 can also be replaced by two linkages that are fixedly connected to each other.

Figure 4A:
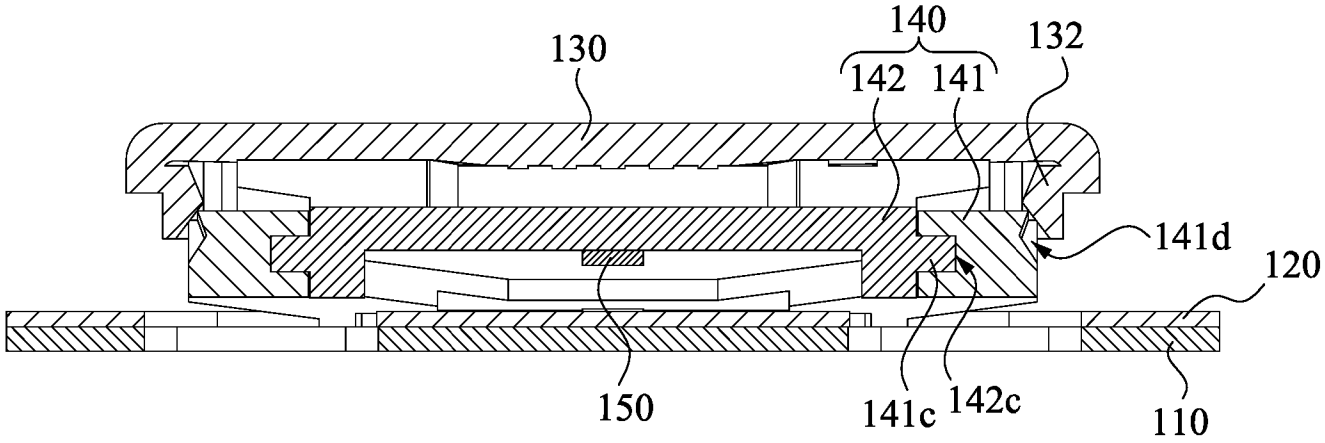
FIG. 4A is a cross-sectional view of the keyswitch device shown in FIG. 2A taken along line 4A-4A after assembled, in which the keycap is located at the highest position.
Figure 4B:
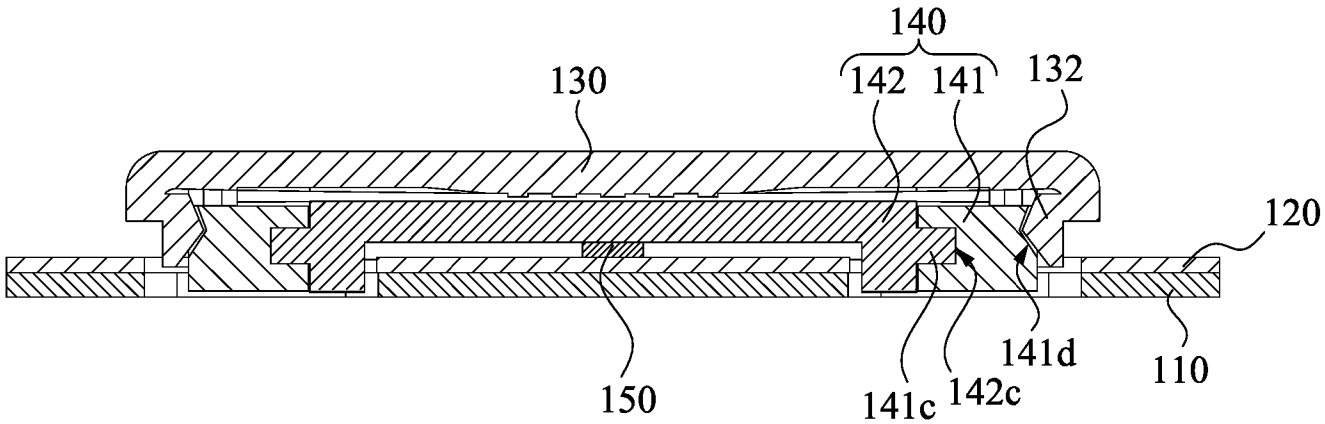
FIG. 4B is another cross-sectional view of the keyswitch device shown in FIG. 4A, in which the keycap is located at the lowest position.

Reference is made to FIGS. 4A and 4B. FIG. 4A is a cross-sectional view of the keyswitch device shown in FIG. 2A taken along line 4A-4A after assembled, in which the keycap 130 is located at the highest position. FIG. 4B is another cross-sectional view of the keyswitch device shown in FIG. 4A, in which the keycap 130 is located at the lowest position. As shown in FIGS. 4A and 4B, two adjacent members of the base 110, the keycap 130, and the first and second connecting members 141, 142 respectively have a protrusion 132 and a recess 141*d*. As shown in the embodiment of FIGS. 4A and 4B, the said adjacent members are the first connecting member 141 and the keycap 130. The protrusion 132 is located on the keycap 130, and the recess 141*d* is located on the first connecting member 141. During a movement of the keycap 130 from the highest position toward the lowest position, the protrusion 132 slidably abuts against the first connecting member 141 and is located outside the recess 141*d*. When the keycap 130 is located at the lowest position, the protrusion 132 falls into the recess 141*d*, so as to provide a feeling of pressing (i.e., a stepped sense) to the user. When the keycap 130 is released, the first and second connecting members 141, 142 will elastically recover to make the protrusion 132 leave the recess 141*d*. In practical applications, the protrusion 132 can be disposed on the first connecting member 141 instead, and the recess 141*d* can be correspondingly disposed on the keycap 130 instead.

Figure 5:
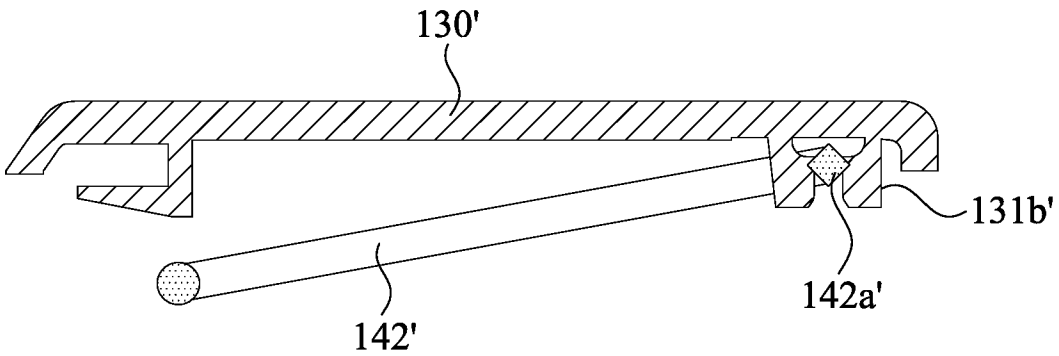
FIG. 5 is a cross-sectional view of a keycap and a second connecting member according to an embodiment of the disclosure.

Reference is made to FIG. 5. FIG. 5 is a cross-sectional view of a keycap 130' and a second connecting member 142' according to an embodiment of the disclosure. In some embodiments, the keycap 130 and the second connecting member 142 as shown in FIG. 3A can be respectively replaced by the keycap 130' and the second connecting member 142' of the present embodiment. The keycap 130' and the second connecting member 142' of the present embodiment are fixedly connected. In order to achieve the purpose of fixedly connecting the keycap 130' and the second connecting member 142', a second upper engaging shaft 142*a*' of the second connecting member 142' is designed as a non-circular shaft (e.g., a square shaft), and an engaging portion 131*b*' of the keycap 130' is correspondingly designed to have a shape which is configured to engage the second upper engaging shaft 142*a*' and makes it impossible to rotate. For example, the engaging portion 131*b*' shown in FIG. 5 has an entrance which allows the square shaft to enter and an inner wall surface extended from the entrance. The shape of the inner wall surface partially matches the shape of the square shaft, so the square shaft can be engaged with the inner wall surface of the engaging portion 131*b*' and is unable to rotate. In practical applications, structures of the second upper engaging shaft 142*a*' and the engaging portion 131*b*' can be exchanged. In addition, the second connecting member 142' of the present embodiment and the first connecting member 141 as shown in FIG. 3A can be pivotally connected instead.

With the foregoing modified structural configurations, when the keycap 130' is not pressed (with reference to FIG. 3A), the keycap 130' and the second connecting member 142' that are connected to each other can support and keep the keycap 130' at the highest position. When the keycap 130' is pressed (with reference to FIG. 3B), since the second upper engaging shaft 142*a*' of the second connecting member 142' and the engaging portion 131*b*' of the keycap 130' are engaged with each other and unable to rotate relative to each other, the second connecting member 142' will elastically deform to store elastic potential energy, and the keycap 130' is pressed to move toward the base 110. When the keycap 130' is released, the second connecting members 142' will elastically recover to return the keycap 130' to the highest position (i.e., to the original position where the keycap 130' has not been pressed). In other words, the keycap 130' and the second connecting member 142' that are fixedly connected to each other in the present embodiment can effectively provide the position-returning function provided by conventional rubber domes, so the conventional rubber domes could be effectively replaced according to the configuration of the keyboard of the present embodiment.

Figure 6:
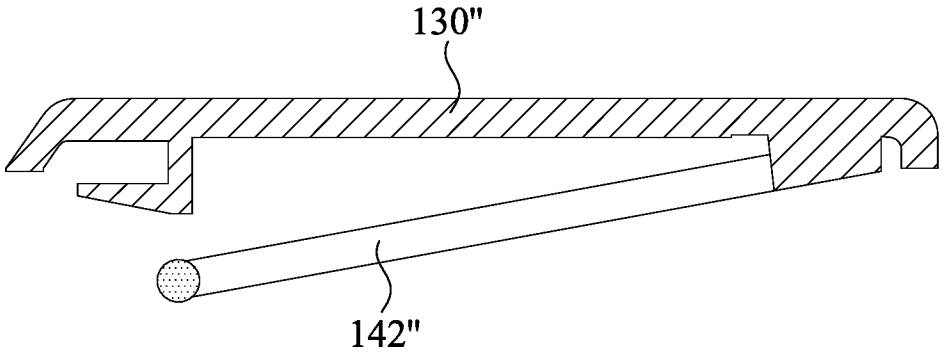
FIG. 6 is a cross-sectional view of a keycap and a second connecting member according to an embodiment of the disclosure.

Reference is made to FIG. 6. FIG. 6 is a cross-sectional view of a keycap 130" and a second connecting member 142" according to an embodiment of the disclosure. In some embodiments, the keycap 130 and the second connecting member 142 as shown in FIG. 3A can be respectively replaced by the keycap 130" and the second connecting member 142" of the present embodiment. The keycap 130" and the second connecting member 142" of the present embodiment are fixedly connected to each other. Compared to the embodiment of FIG. 5, the keycap 130" and the second connecting member 142" of the present embodiment are two portions of a unitary structure. For example, the keycap 130" and the second connecting member 142" include identical or different materials and can be fabricated into the unitary structure by an injection molding process.

Figure 7:
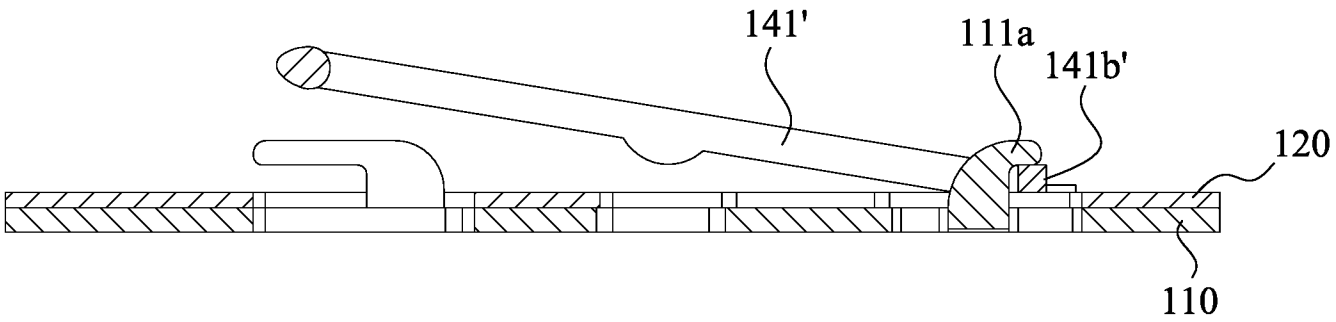
FIG. 7 is a cross-sectional view of a base, a circuit board, and a first connecting member according to an embodiment of the disclosure.

Reference is made to FIG. 7. FIG. 7 is a cross-sectional view of the base 110, the circuit board 120, and a first connecting member 141' according to an embodiment of the disclosure. In some embodiments, the first connecting member 141 as shown in FIG. 3A can be replaced by the first connecting member 141' of the present embodiment. The base 110 and the first connecting member 141' of the present embodiment are fixedly connected to each other. In order to achieve the purpose of fixedly connecting the base 110 and the first connecting member 141', a first lower engaging shaft 141*b*' of the first connecting member 141' can be designed as a non-circular shaft (e.g., a square shaft), so it will get stuck and be unable to rotate when it is engaged with the coupling mechanism 111*a* of the base 110. In addition, the first connecting member 141' of the present embodiment and the second connecting member 142 as shown in FIG. 3A can be pivotally connected to each other instead.

With the foregoing modified structural configurations, when the keycap 130 is not pressed (with reference to FIG. 3A), the keycap 130 and the first connecting member 141' that are engaged with each other can support and keep the keycap 130 at the highest position. When the keycap 130 is pressed (with reference to FIG. 3B), since the first lower engaging shaft 141*b*' of the first connecting member 141' and the coupling mechanism 111*a* of the base 110 are engaged with each other and unable to rotate relative to each other, the first connecting member 141' will elastically deform to store elastic potential energy, and the keycap 130 is pressed to move toward the base 110. When the keycap 130 is released, the first connecting member 141' will elastically recover to return the keycap 130 to the highest position (i.e., to the original position where the keycap 130 has not been pressed). In other words, the base 110 and the first connecting member 141' that are fixedly connected to each other in the present embodiment can effectively provide the position-returning function provided by conventional rubber domes, so the conventional rubber domes could be effectively replaced according to the configuration of the keyboard of the present embodiment.

Figure 8:
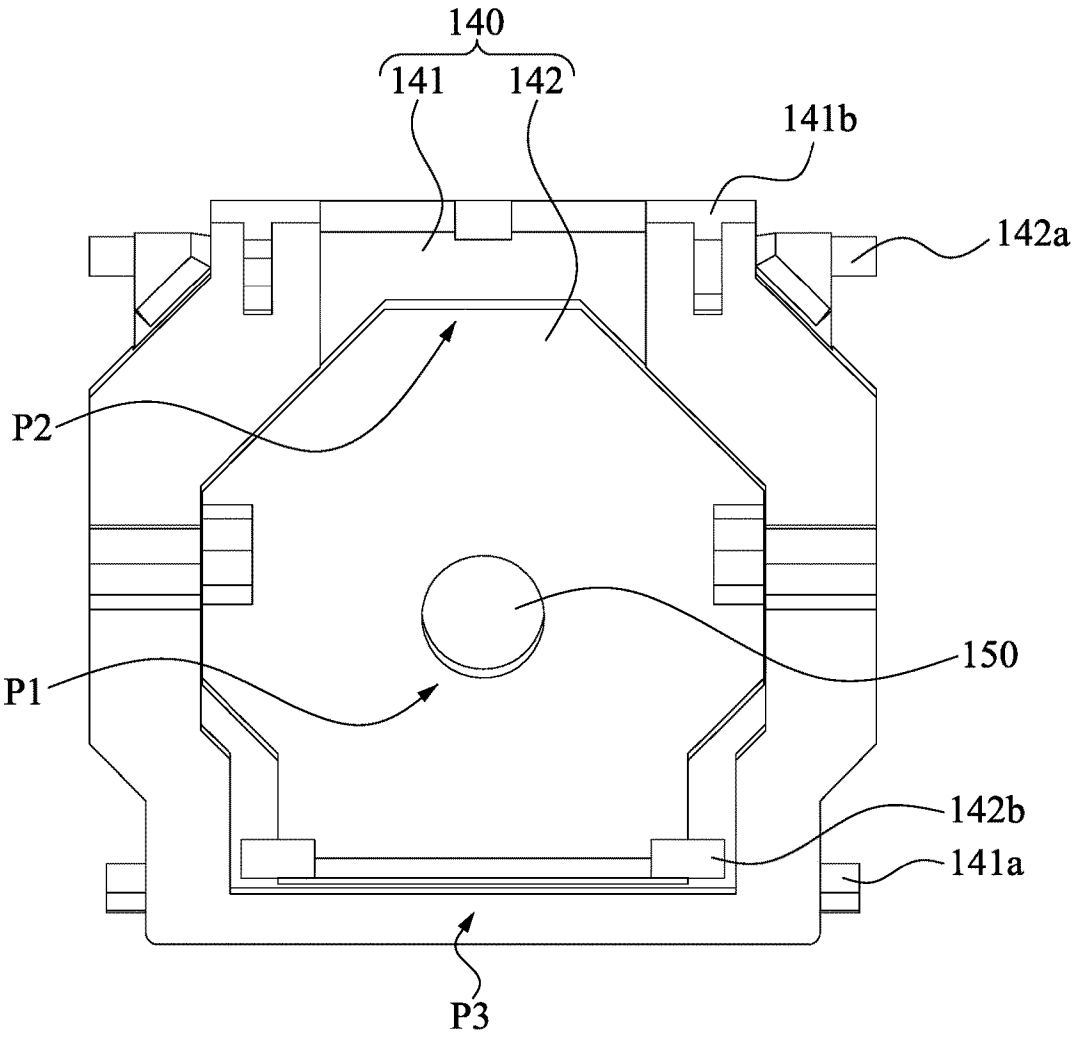
FIG. 8 is a bottom view of a connecting assembly shown in FIG. 2A.

Reference is made to FIG. 8. FIG. 8 is a bottom view of the connecting assembly 140 shown in FIG. 2A. As shown in FIGS. 2A and 8, the keyboard 100 further includes a triggering member 150. The triggering member 150 is disposed on a surface of the second connecting member 142 facing toward the circuit board 120 (i.e., the bottom surface of the second connecting member 142) and faces toward the circuit board 120. The triggering member 150 is configured to contact the circuit board 120 when the keycap 130 moves to the lowest position. In an embodiment, the triggering member 150 can include a conductive material. The mechanism and principle for the circuit board 120 to be pressed by the triggering member 150 to generate a trigger signal can be referred to the related prior art, and are not described herein. In the present embodiment, the triggering member 150 is substantially located at a center (as a position P1 shown in FIG. 8) of the surface of the second connecting member 142, but the disclosure is not limited in this regard. In practical applications, the triggering member 150 can be disposed at a position close to an edge of the keycap 130 instead, such as a position P2 (at an edge of the second connecting member 142) or a position P3 (at an edge of the first connecting member 141) as shown in FIG. 8.

Figure 9A:
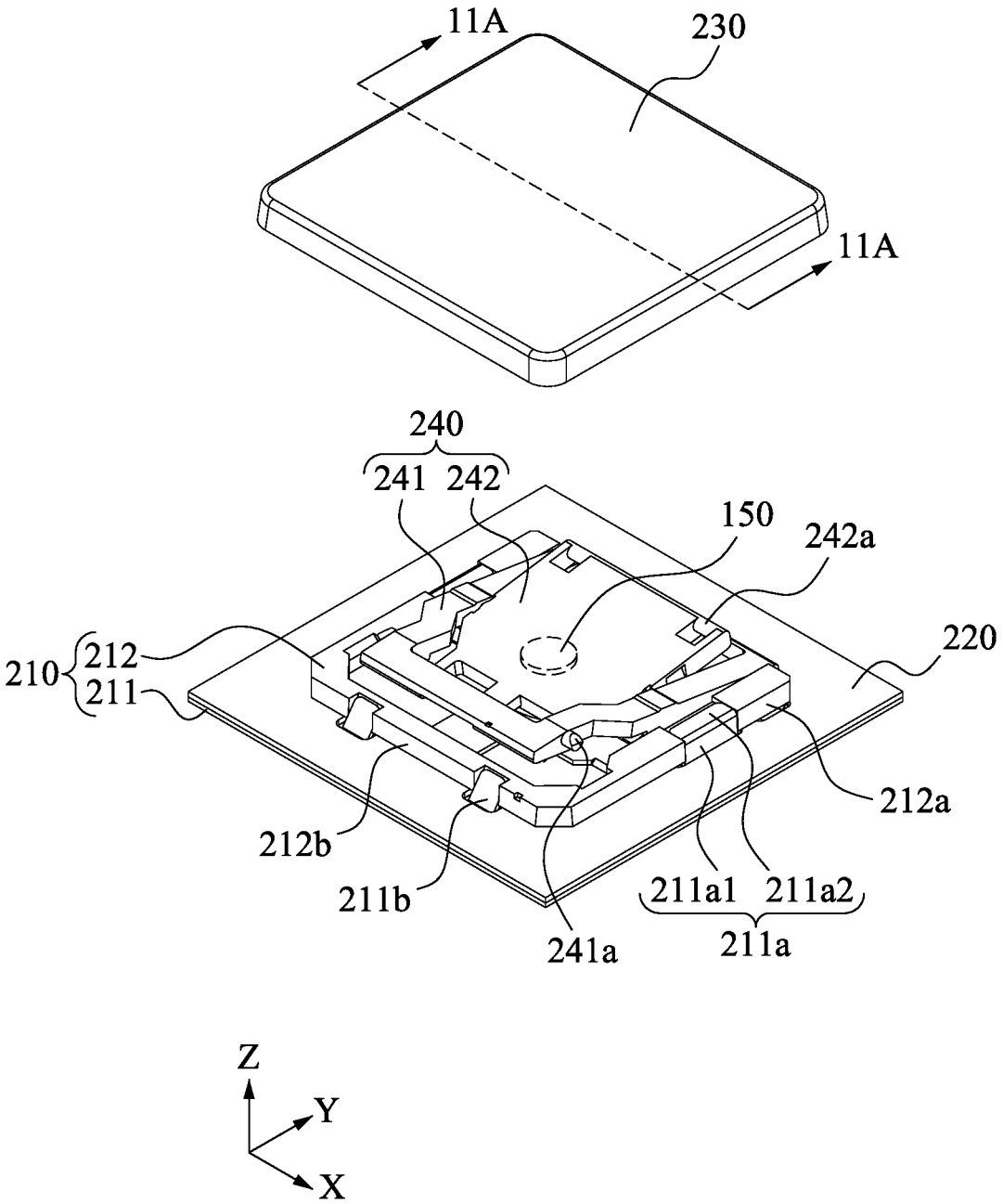
FIG. 9A is a partial perspective view of a keyswitch device according to an embodiment of the disclosure, in which a keycap is separated upward.
Figure 9B:
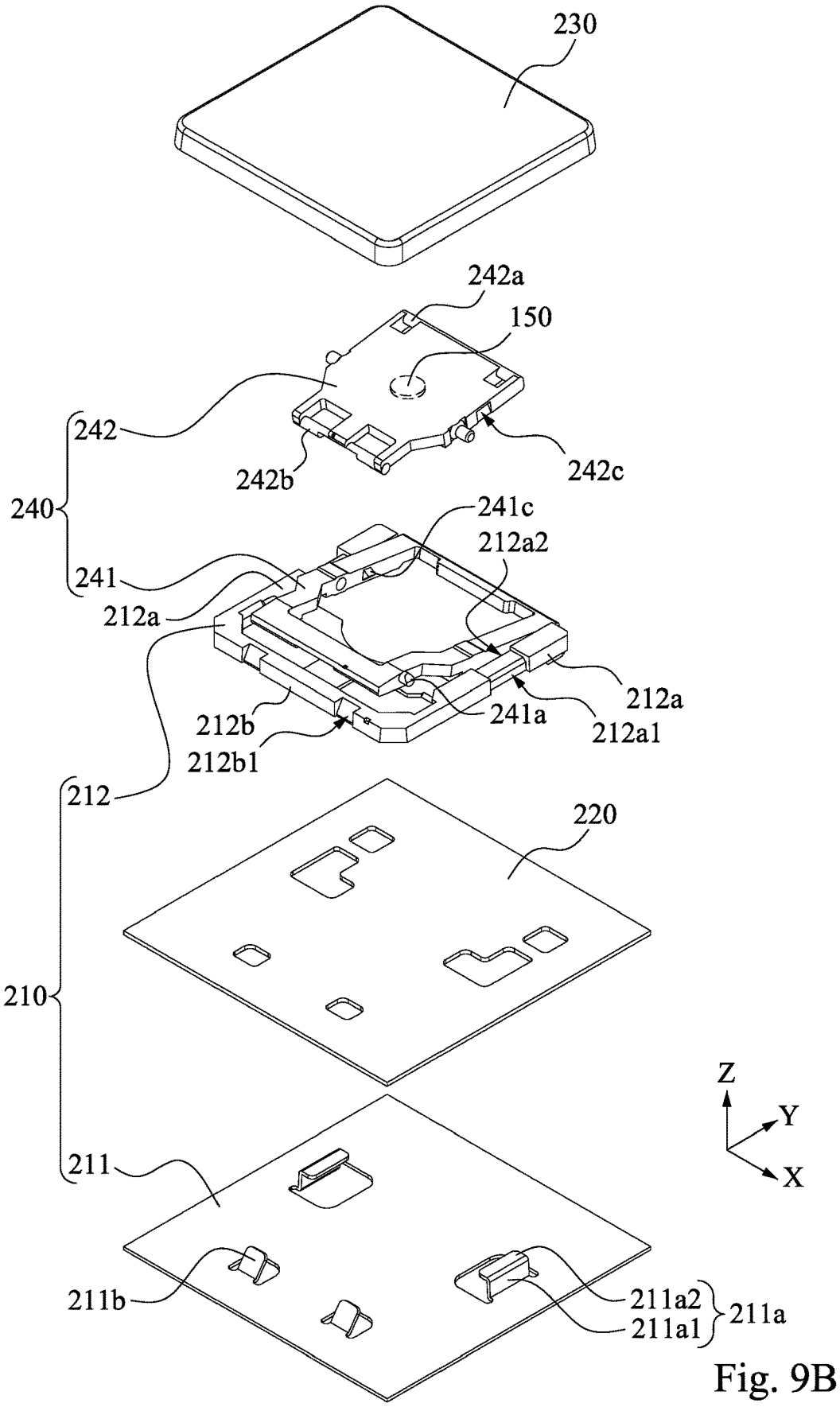
FIG. 9B is an exploded view of the keyswitch device shown in FIG. 9A.

Reference is made to FIGS. 9A and 9B. FIG. 9A is a partial perspective view of a keyswitch device according to an embodiment of the disclosure, in which a keycap 230 is separated upward. FIG. 9B is an exploded view of the keyswitch device shown in FIG. 9A. As shown in FIGS. 9A and 9B, the keyswitch device includes a base 210, a circuit board 220, a keycap 230, and a connecting assembly 240. The base 210 includes a substrate 211 and a plastic frame 212. The connecting assembly 240 is located between the base 210 and the keycap 230 and includes a first connecting member 241 and a second connecting member 242 that are connected to each other. The plastic frame 212 is fixed on the substrate 211 and connected to the first and second connecting members 241, 242.

Specifically, the plastic frame 212 includes two fixing bars 212*a* and a connecting bar 212*b*. The connecting assembly 240 is connected to the two fixing bars 212*a* with the first connecting member 241. In addition, the substrate 211 includes two engaging structures 211*a*. The engaging structures 211*a* are respectively engaged with the fixing bars 212*a*. Specifically, each of the engaging structures 211*a* includes a first engaging portion 211*a*1 and a second engaging portion 211*a*2. The first engaging portion 211*a*1 abuts against the side wall of the corresponding fixing bar 212*a*. The second engaging portion 211*a*2 is connected to the first engaging portion 211*a*1 and abuts against the top of the corresponding fixing bar 212*a*. The two fixing bars 212*a* of the plastic frame 212 are retained between the two first engaging portions 211*a*1, so as to limit the movement of the plastic frame 212 in a direction parallel to the substrate 211 (e.g., X-direction). Any of the fixing bars 212*a* of the plastic frame 212 is further retained between the circuit board 220 and the corresponding second engaging portion 211*a*2, so as to limit the movement of the plastic frame 212 in a direction perpendicular to the substrate 211 (e.g., Z-direction).

Furthermore, in the present embodiment, each of the fixing bars 212*a* has a first engaging notch 212*a*1 and a second engaging notch 212*a*2 respectively located at the side wall and the top of the fixing bar 212*a* and respectively engaged with the first engaging portion 211*a*1 and the second engaging portion 211*a*2 of the corresponding engaging structure 211*a*, so as to limit the movement of the plastic frame 212 in another direction parallel to the substrate 211 (e.g., Y-direction). Specifically, parts of the side wall of the fixing bar 212*a* adjacent to two ends of the first engaging notch 212*a*1 protrude relative to the first engaging notch 212*a*1 with a thickness. Similarly, parts of the top of the fixing bar 212*a* adjacent to two ends of the second engaging notch 212*a*2 protrude relative to the second engaging notch 212*a*2 with a thickness. Hence, the fixing bar 212*a* can use the parts protruding at the two ends of the first engaging notch 212*a*1 (or the second engaging notch 212*a*2) to abut against the corresponding engaging structure 211*a* so as to be retained.

In practical applications, each of the fixing bars 212*a* can only have the first engaging notch 212*a*1 or only have second engaging notch 212*a*2, and the purpose of limiting the movement of the plastic frame 212 in another direction parallel to the substrate 211 (e.g., Y-direction) could also be achieved.

As shown in FIGS. 9A and 9B, in the present embodiment, the substrate 211 further includes a pressing structure 211*b*. The pressing structure 211*b* is obliquely disposed and presses the connecting bar 212*b* toward the substrate 211, so as to further firmly fix the plastic frame 212 on the substrate 211. Specifically, the connecting bar 212*b* has a receiving structure 212*b*1 which forms a recess on the connecting bar 212*b*. The recess formed by the receiving structure 212*b*1 forms an inclined surface between the bottom and the top of the connecting bar 212*b*. Hence, the pressing structure 211*b* is engaged in the recess formed by the receiving structure 212*b*1 and abuts against the inclined surface formed by the receiving structure 212*b*1 in the recess, so as to press the connecting bar 212*b* toward the substrate 211.

In the present embodiment, the substrate 211 is a metal plate, and the engaging structures 211*a* and the pressing structure 211*b* can be structures integrally formed on the substrate 211 (e.g., structures fabricated from the substrate 211 by using a stamping process, and the engaging structures 211*a* further need a bending process), but the disclosure is not limited in this regard. Since the engaging structures 211*a* and the pressing structure 211*b* are responsible for fixing the plastic frame 212, the requirement to the manufacturing accuracy is not high and thus the manufacturing cost can be reduced.

As shown in FIGS. 9A and 9B, in the present embodiment, the connecting assembly 240 is a scissors-like connecting assembly as an example, but the disclosure is not limited in this regard. In practical applications, the connecting assembly 240 can be replaced by other supporting structures having the similar function (i.e., the function of guiding the keycap 230 to move up and down relative to the base 210), such as a V-shaped, a A-shaped, or a two parallel linkage structure.

Figure 10A:
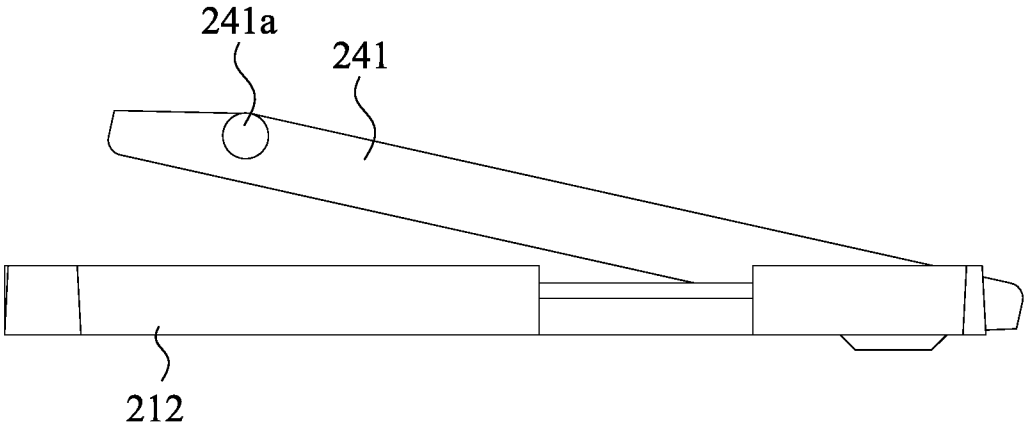
FIG. 10A is a side view of a plastic frame and a first connecting member according to an embodiment of the disclosure.
Figure 10B:
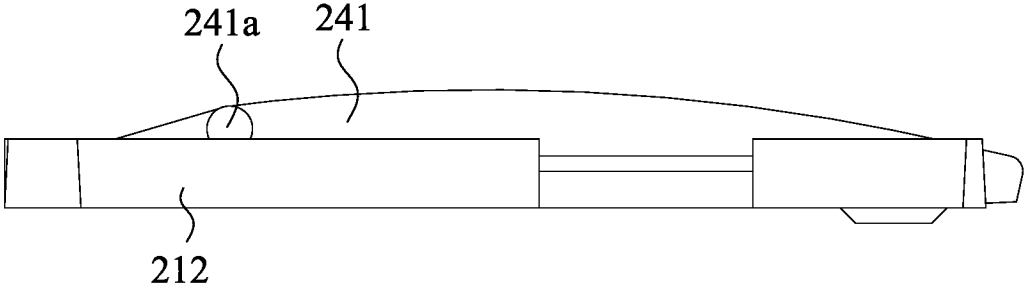
FIG. 10B is another side view of the structure shown in FIG. 10A, in which the first connecting member deforms toward the plastic frame.

Reference is made to FIGS. 10A and 10B. FIG. 10A is a side view of the plastic frame 212 and the first connecting member 241 according to an embodiment of the disclosure. FIG. 10B is another side view of the structure shown in FIG. 10A, in which the first connecting member 241 deforms toward the plastic frame 212. As shown in FIGS. 9A to 10B, the first connecting member 241 is fixedly connected to the two fixing bars 212*a* of the plastic frame 212 and slidably engaged with the keycap 130 with the first upper engaging shaft 241*a*. The second connecting member 242 is pivotally connected to the keycap 230 with the second upper engaging shaft 242*a* and slidably engaged with the plastic frame 212 with the lower engaging shaft 242*b*. The first connecting member 241 and the second connecting member 242 are pivotally connected to each other. With the structural configurations, when the keycap 230 is not pressed, the plastic frame 212 and the first connecting members 241 that are connected to each other can support and keep the keycap 230 at the highest position. When the keycap 230 is pressed, the first connecting members 241 that is fixedly connected to the plastic frame 212 will elastically deform to store elastic potential energy, and the keycap 230 moves toward the base 210. When the keycap 230 is released, the first connecting member 241 will elastically recover to return the keycap 230 to the highest position. In other words, the plastic frame 212 and the first connecting members 241 that are fixedly connected to each other in the present embodiment can effectively provide the position-returning function provided by conventional rubber domes, so the conventional rubber domes could be effectively replaced according to the configuration of the keyboard 100 of the present disclosure.

In the present embodiment, the plastic frame 212 and the first connecting members 241 are two parts of a unitary structure. For example, the plastic frame 212 and the first connecting members 241 include identical or different materials and can be fabricated into the unitary structure by an injection molding process. In other embodiments, the plastic frame 212 and the first connecting members 241 can be detachably connected to each other instead, which is like the connection relationship between the keycap 130' and the second connecting member 142' as shown in FIG. 5.

Figure 11A:
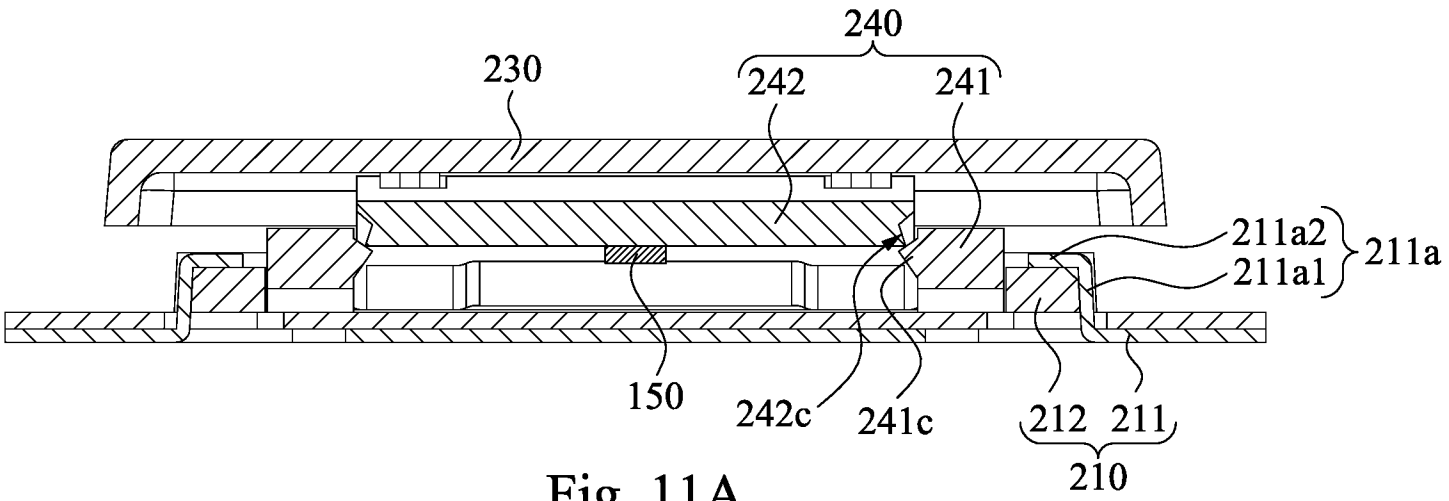
FIG. 11A is a cross-sectional view of the keyswitch device shown in FIG. 9A taken along line 11A-11A after assembled, in which the keycap is located at the highest position.
Figure 11B:
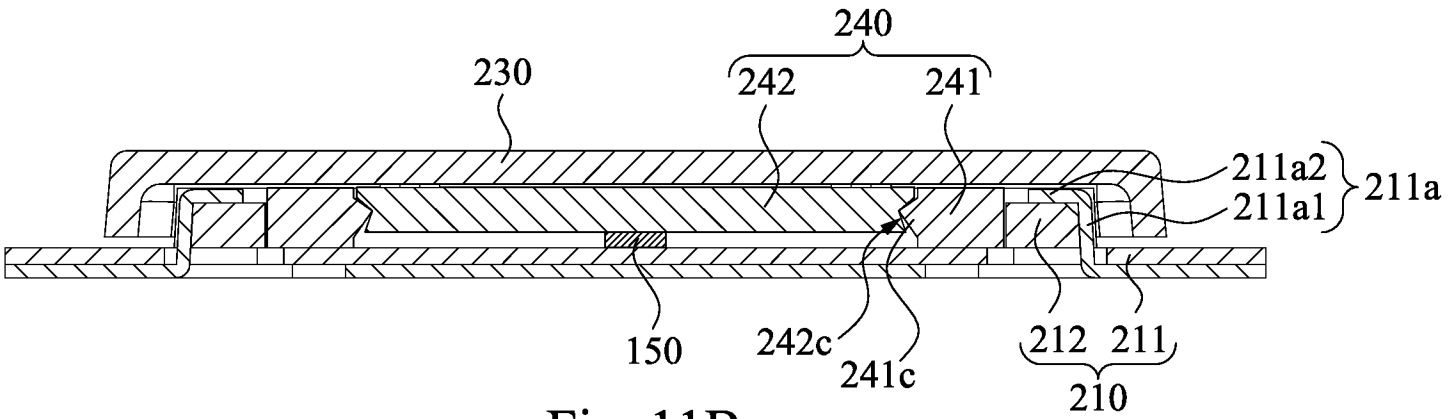
FIG. 11B is another cross-sectional view of the keyswitch device shown in FIG. 11A, in which the keycap is located at the lowest position.

Reference is made to FIGS. 11A and 11B. FIG. 11A is a cross-sectional view of the keyswitch device shown in FIG. 9A taken along line 11A-11A after assembled, in which the keycap 230 is located at the highest position. FIG. 11B is another cross-sectional view of the keyswitch device shown in FIG. 11A, in which the keycap 230 is located at the lowest position. As shown in FIGS. 11A and 11B, the first connecting member 241 and the second connecting member 242 respectively have a protrusion 241*c* and a recess 242*c*. During a movement of the keycap 230 from the highest position toward the lowest position, the protrusion 241*c* slidably abuts against the second connecting member 242 and is located outside the recess 242*c*. When the keycap 230 is located at the lowest position, the protrusion 241*c* falls into the recess 242*c*, so as to provide a feeling of pressing the keycap 230 (i.e., a stepped sense) to the user. When the keycap 230 is released, the first connecting member 241 will elastically recover to return the keycap 230 to the highest position and make the protrusion 241*c* leave the recess 242*c*. In practical applications, the protrusion 241*c* can be disposed on the second connecting member 242 instead, and the recess 242*c* can be correspondingly disposed on the first connecting member 241 instead.

Figure 12A:
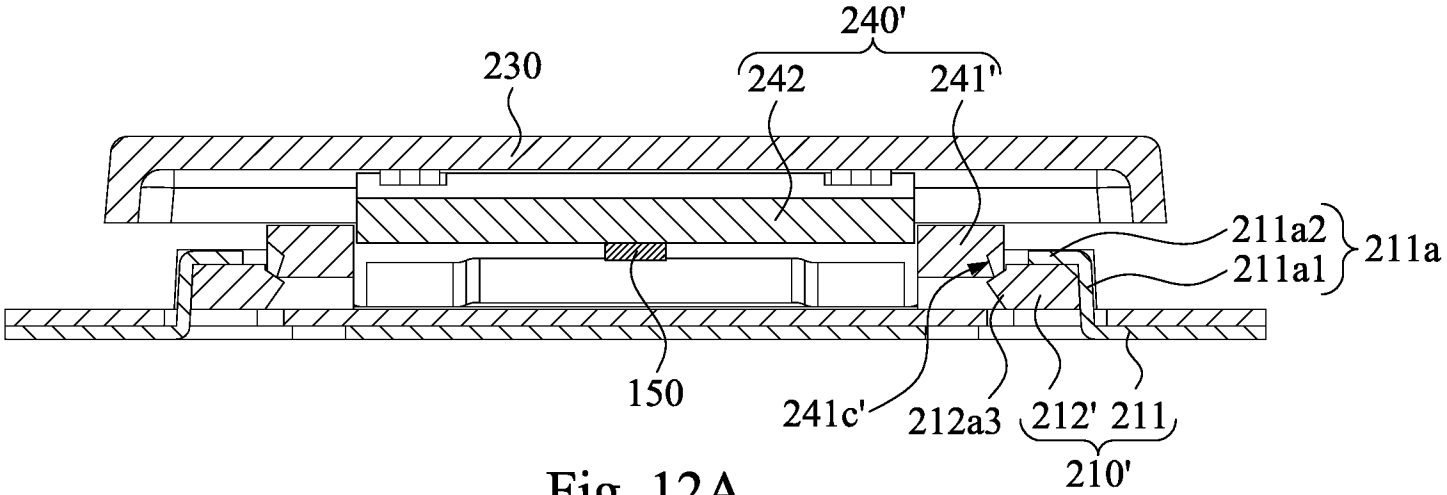
FIG. 12A is a cross-sectional view of a keyswitch device according to an embodiment of the disclosure, in which the keycap is located at the highest position.
Figure 12B:
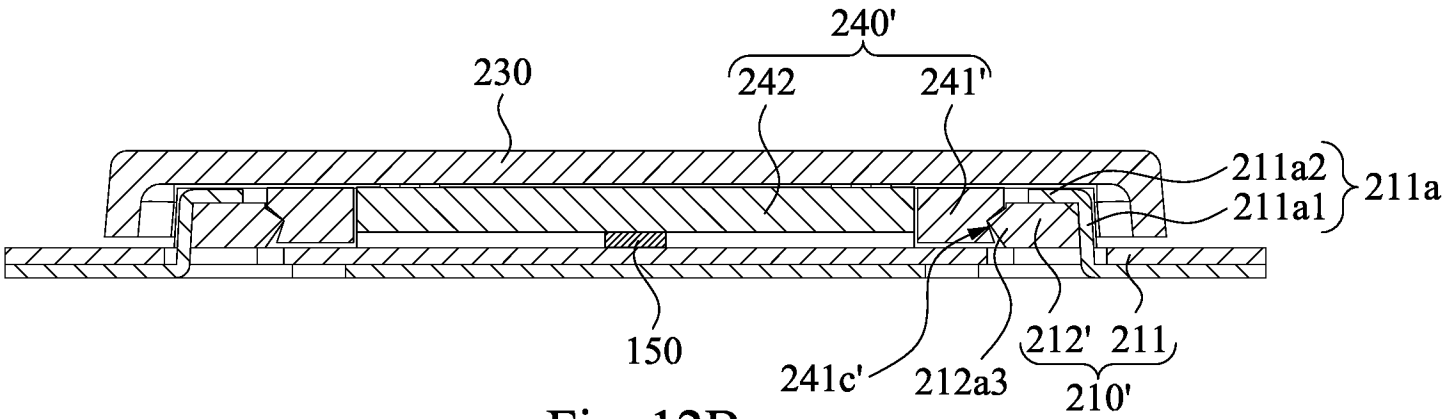
FIG. 12B is another cross-sectional view of the keyswitch device shown in FIG. 12A, in which the keycap is located at the lowest position.

Reference is made to FIGS. 12A and 12B. FIG. 12A is a cross-sectional view of a keyswitch device according to an embodiment of the disclosure, in which the keycap 230 is located at the highest position. FIG. 12B is another cross-sectional view of the keyswitch device shown in FIG. 12A, in which the keycap 230 is located at the lowest position. As shown in FIGS. 12A and 12B, a plastic frame 212' of a base 210' and a first connecting member 241' of a connecting assembly 240' respectively have a protrusion 212*a*3 and a recess 241*c*'. During a movement of the keycap 230 from the highest position toward the lowest position, the protrusion 212*a*3 slidably abuts against the first connecting member 241' and is located outside the recess 241*c*'. When the keycap 230 is located at the lowest position, the protrusion 212*a*3 falls into the recess 241*c*', so as to provide a feeling of pressing the keycap 230 (i.e., a stepped sense) to the user. When the keycap 230 is released, the first connecting member 241' will elastically recover to return the keycap 230 to the highest position and make the protrusion 212*a*3 leave the recess 241*c*'. In practical applications, the protrusion 212*a*3 can be disposed on the first connecting member 241' instead, and the recess 241*c*' can be correspondingly disposed on the plastic frame 212' instead.

According to the foregoing recitations of the embodiments of the disclosure, it can be seen that in the keyboard of the present disclosure, since two connected members of the base, the keycap, and the first and second connecting members are fixedly connected, at least one of said two connected members elastically deform to store elastic potential energy when the keycap is pressed and elastically recover to return the keycap to its original position when the keycap is released. Moreover, in the keyboard of the present disclosure, two adjacent members of the base, the keycap, and the first and second connecting members respectively have a protrusion and a recess. When the keycap is pressed to move to the lowest position, the protrusion falls into the recess, so as to provide a feeling of pressing the keycap (i.e., a stepped sense) to the user. Therefore, the conventional rubber domes could be effectively replaced according to the configuration of the keyboard of the present disclosure.

Although the present disclosure has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present disclosure without departing from the scope or spirit of the disclosure. In view of the foregoing, it is intended that the present disclosure cover modifications and variations of this disclosure provided they fall within the scope of the following claims.

What is claimed is:

1. A keyboard, comprising:

a base;

a keycap located over the base; and a connecting assembly located between the base and the keycap and comprising a first connecting member and a second connecting member connected to each other, each of the first connecting member and the second connecting member being connected to the base and the keycap, wherein two connected members of the base, the keycap, and the first and second connecting members are non-rotatably connected, wherein when the keycap is pressed from an original position thereof toward the base, at least one of the first and second connecting members elastically deforms to store elastic potential energy, and when the keycap is released, said at least one of the first and second connecting members elastically recovers to return the keycap to the original position.

2. The keyboard of claim 1, wherein said two connected members are detachably connected.

3. The keyboard of claim 2, wherein said two connected members are the first and second connecting members, each of the first and second connecting members has a connecting portion, and the connecting portions of the first connecting member and the connecting portion of the second connecting member are engaged with each other and unable to rotate relative to each other.

4. The keyboard of claim 2, wherein said two connected members are one of the first and second connecting members and the base, said one of the first and second connecting members has a lower engaging shaft, the base has a coupling mechanism, and the lower engaging shaft and the coupling mechanism are engaged with each other and unable to rotate relative to each other.

5. The keyboard of claim 2, wherein said two connected members are one of the first and second connecting members and the keycap, said one of the first and second connecting members has an upper engaging shaft, the keycap has an engaging portion, and the upper engaging shaft and the engaging portion are engaged with each other and unable to rotate relative to each other.

6. The keyboard of claim 1, wherein said two connected members are two portions of a unitary structure.

7. The keyboard of claim 1, further comprising:

a circuit board, wherein the base partially passes through the circuit board to be connected to the connecting assembly; and a triggering member disposed on the connecting assembly and facing toward the circuit board.

8. The keyboard of claim 7, wherein the first connecting member surrounds an outer edge of the second connecting member, and the triggering member is disposed on a surface of the second connecting member facing toward the circuit board.

9. The keyboard of claim 8, wherein the triggering member is substantially located at a center of the surface of the second connecting member.

10. The keyboard of claim 7, wherein the triggering member is close to an edge of the keycap.

11. The keyboard of claim 1, wherein the connecting assembly is configured to guide the keycap to move between a highest position and a lowest position relative to the base, two adjacent members of the base, the keycap, and the first and second connecting members respectively have a protrusion and a recess, during a movement of the keycap from the highest position toward the lowest position, the protrusion slidably abuts against one of said adjacent members having the recess and is located outside the recess, and when the keycap is located at the lowest position, the protrusion falls into the recess.

12. The keyboard of claim 11, wherein said adjacent members are the first and second connecting members.

13. The keyboard of claim 11, wherein the first connecting member surrounds an outer edge of the second connecting member, and said adjacent members are the first connecting member and the keycap.

14. The keyboard of claim 11, wherein said adjacent members are one of the first and second connecting members and the base.

15. The keyboard of claim 1, wherein the base comprises:

a substrate; and a plastic frame fixed on the substrate and connected to the first and second connecting members.

* * * * *